US006338643B1

(12) United States Patent
Miller et al.

(10) Patent No.: US 6,338,643 B1
(45) Date of Patent: Jan. 15, 2002

(54) STUFFER CAP MECHANISM FOR AN ELECTRICAL CONNECTOR

(75) Inventors: Alan C. Miller, Guilford; John J. Milner, Milford, both of CT (US); Raul G. Pereira, Cumberland, RI (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/675,652

(22) Filed: Sep. 29, 2000

(51) Int. Cl.[7] ..... H01R 4/24
(52) U.S. Cl. ..... 439/417; 439/676
(58) Field of Search ..... 439/417, 395, 439/404, 676, 367

(56) References Cited

U.S. PATENT DOCUMENTS

| | | | | |
|---|---|---|---|---|
| 5,186,647 A | | 2/1993 | Denkmann et al. | 439/395 |
| 5,228,872 A | | 7/1993 | Liu | 439/607 |
| 5,403,200 A | | 4/1995 | Chen | 439/404 |
| 5,624,274 A | * | 4/1997 | Lin | 439/417 |
| 5,626,490 A | | 5/1997 | Pitts et al. | 439/404 |
| 5,947,752 A | * | 9/1999 | Wu | 439/404 |
| 6,116,943 A | | 9/2000 | Ferrill et al. | 439/418 |
| 6,157,574 A | * | 12/2000 | Wu | 439/676 |

OTHER PUBLICATIONS

Hubbell Premise Wiring, Inc., Catalog #1100R, published prior to Sep. 1999, pp. 12–19.

* cited by examiner

*Primary Examiner*—Tho D. Ta
(74) *Attorney, Agent, or Firm*—Mark S. Bicks; Jeffrey J. Howell

(57) ABSTRACT

A wiring unit for an electrical connector having a housing with a first side and an opposing second side, an attaching portion on the second side and a latching portion adjacent the attaching portion. The latching portion couples the wiring unit to a standard support. Electrical wiring terminals are coupled to the housing and can receive electrical wires. A stuffer cap is selectively coupled to the terminals and the attaching portion. When the stuffer cap is coupled to the attachment portion, attachment of the electrical wires to the terminals using an impact tool can be accomplished without damaging the latching portion since the stuffer cap spaces the latching portion from the support surface when the wires are forced into the terminals. When the stuffer cap is coupled to the terminals, the stuffer cap eliminates or substantially reduces oxidation or corrosion on the terminals and wires.

20 Claims, 4 Drawing Sheets

STUFFER CAP MECHANISM FOR AN ELECTRICAL CONNECTOR

REFERENCE TO RELATED APPLICATION

This application is related to U.S. patent application Ser. No. 09/250,186 of John J. Milner, Joseph E. Dupuis, Richard A. Fazio, and Robert A. Aekins, filed Feb. 16, 1999, U.S. Pat. No. 6,193,526 and entitled "Wiring Unit with Angled Insulation Displacement Contacts" and to U.S. patent application Ser. No. 09/250,187 of John J. Milner, Richard A. Fazio, and Robert A. Aekins, filed Mar. 4, 1999, 2000, and entitled "Wiring Unit with Paired In-Line Insulating Displacement Contacts", the subject matter of both of which arc hereby incorporated by reference.

FIELD OF THE INVENTION

The present invention relates to a wiring unit of an electrical connector for communication and data transmission systems. The wiring unit includes a stuffer cap that may couple to a portion of the wiring unit so that the latch for attaching the wiring unit to a support (e.g., a faceplate) is protected during the termination of electrical wires to electrical wire insulation displacement contact (IDC) terminals of the wiring unit. More particularly, the present invention includes a stuffer cap that can be selectively coupled to one portion of the wiring unit to protect the latch during termination of the electrical wires and to the terminals or IDC of the wiring unit to help stop oxidation and corrosion.

BACKGROUND OF THE INVENTION

Due to significant advancements in telecommunications and data transmission speeds over unshielded twisted pair cables, the connectors (jacks, receptacles, patch panels, cross connects, etc.) have become critical factors in achieving high performance in data transmission systems, particularly at the higher frequencies. Some performance characteristics can degrade beyond acceptable levels at new, higher frequencies in the connectors unless adequate precautions are taken.

Often, wiring is pre-existing. Standards define the geometry for the connectors, such as the size and connection to existing faceplates and other support structures, thus making any changes to the wiring and to the connector geometry cost prohibitive.

The use of unshielded twisted pair wiring was created prior to the need for high speed data transmissions. Thus, while using the existing unshielded twisted pair wiring and complying with the existing standards, connectors must be developed that fulfill the performance requirements of today's higher speed communications, in order to maintain compatibility with the existing connectors.

One method to improve performance has been to use a stuffer cap coupled to the terminals of a jack or interconnection device for an electrical connector. The stuffer cap covers the twisted pair cables after they have been attached to the terminals, and retards or stops oxidation or corrosion on the terminals and termination wires. This retardation of corrosion helps to stop low level contact (voltage resistance) spikes. Examples of this type of stuffer cap are disclosed in U.S. Pat. Nos. 5,186,647 to Denkmann et al and 4,403,200 to Chen.

Generally, the stuffer cap configuration has not changed the geometry of the connector and allows ajack to be coupled to a conventional keystone envelope on a faceplate. The jack typically has a latching mechanism that has one latch or protrusion located on the "bottom" of the jack or opposite side of the wiring terminals and an opposing latch or protrusion located on the "top" of the jack or on the same side as the wiring terminals. The structure of the latching mechanism on the jack is generally perpendicular to the face of the jack that mates with a faceplate or other support. The protrusions couple to recesses in the keystone envelope and thereby hold the jack in place. However, at least one of these latching mechanisms may be damaged during the wire termination process.

Typically the wire termination process is performed using a 10-impact tool. Usually, the jack is positioned with the terminals extending upwardly and away from a support surface to increase efficiency of the wire termination process. However, this orientation typically positions one of the latching mechanisms between the housing of the jack and the support surface on which the jack is placed. The latching mechanism can be damaged by the force of the impact tool forcing the connector and its latching mechanism against the support surface. With a damaged latching mechanism, the jack will not be able to be properly coupled to the faceplate.

Examples of conventional of stuffer caps are disclosed in U.S. Pat. Nos. 6,116,943 to Ferrill et al.; 5,626,490 to Pitts et al.; 5,228,872 to Liu; 5,186,647 to Denkmann et al; and 4,403,200 to Chen.

SUMMARY OF THE INVENTION

Accordingly, an object of the present invention is to provide an electrical connector having a stuffer cap that can couple to the wiring unit in manner that protects the faceplate latching mechanism during wire termination.

Another object of the present invention is to provide an electrical connector having a stuffer cap that couples to the wire-connecting unit to retard or stop oxidation or corrosion on the terminals and termination wires.

Yet another object of the present invention is to provide an electrical connector having a stuffer cap that is simple and inexpensive to manufacture and use.

The foregoing objects are basically obtained by an electrical connector having a housing with opposite first and second sides, a stuffer cap attachment on the second side and a support latching portion adjacent the attachment on the second side. Electrical wire insulation displacement contact terminals are coupled to the housing and extend from the first side. A stuffer cap can be selectively coupled on the housing first surface over the insulation displacement contact terminals and to the attachment overlying the second surface.

The foregoing objects are further obtained by a method for assembling a wiring unit for an electrical connector, the wiring unit including a housing having opposite first and second sides. A stuffer cap attachment extends from the second side and a support latching portion is adjacent the attachment on the second side. Insulation displacement contact terminals are coupled to the housing, the terminals being at least partially covered by a plurality of protrusions on the housing. The method includes, positioning a stuffer cap overlying the second side and coupling the stuffer cap to the stuffer cap attachment, the stuffer cap extending farther from the second surface than the latching portion. The stuffer cap is placed on a surface, the stuffer cap separating the latching portion from the surface. Then electrical wires are positioned on the insulation displacement contact terminals and forces are exerted on the electrical wires, thereby coupling the electrical wires to the insulation displacement contact terminals coupled to the housing. The stuffer cap absorbs the force transferred to the housing and protect the latching portion. The stuffer cap can then be separated from the attaching portion and attached to the protrusions on the housing.

By forming an electrical connector and performing the method according to the invention, the stuffer cap will help retard or stop oxidation or corrosion on the terminals and termination wires. Additionally, the stuffer cap can be coupled to the housing side opposite the terminals so that when an impact tool is used to terminate the electrical wires to the electrical connector, the latching portion is protected to avoid being damaged.

Other objects, advantages and salient features of the invention will become apparent from the following detailed description, which, taken in conjunction with the annexed drawings, discloses a preferred embodiment of the invention.

As used herein, terms, such as "front", "rear", "upwardly", "downwardly", "forwardly" and "backwardly", are intended to describe relative directions, and do not limit the electrical connector to any specific orientation.

BRIEF DESCRIPTION OF THE DRAWINGS

Referring to the drawings which form a part of this disclosure.

DETAILED DESCRIPTION OF THE PREFERRED EMBODIMENT

Figure 1:
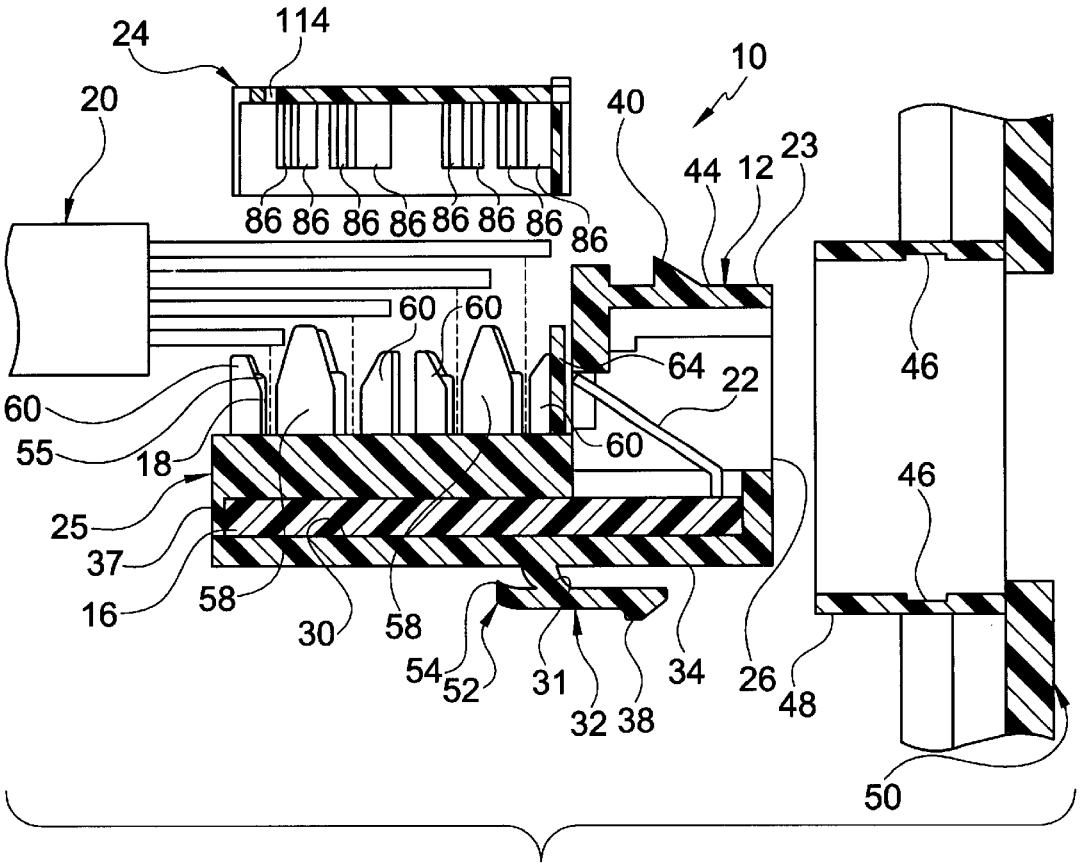
FIG. 1 is an exploded side elevational view in section of an electrical connector and faceplate support according to the present invention.
Figure 2:
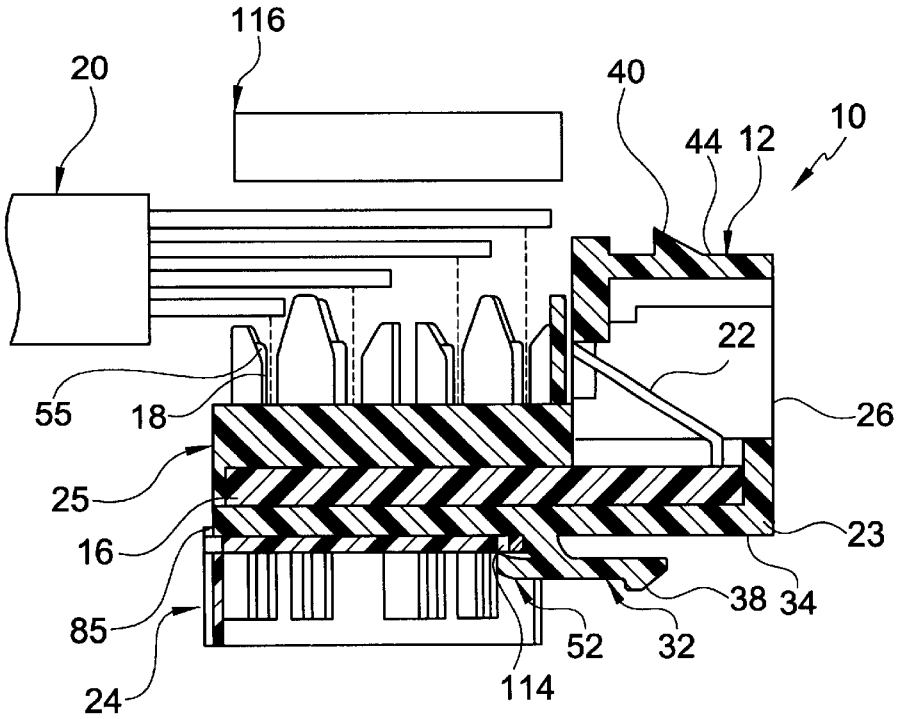
FIG. 2 is a side elevational view in section of the electrical connector of FIG. 1 with a stuffer cap coupled to the stuffer cap attachment portion, prior to engagement of the terminal wires.

A high density electrical connector 10 for telecommunication systems and for coupling to a faceplate 50 or other support according to the present invention is illustrated in FIGS. 1 and 2. The connector comprises a connector body or housing 12 and a printed circuit board 16 on which terminals 18 are mounted. The terminals 18 are standard 110 electrical wire insulation displacement contacts (IDC), and couple to standard electrical or terminal wiring or wires 20, as shown specifically in FIG. 5. Through printed conductors on the circuit board, terminals 18 are electrically and mechanically coupled to resilient contacts 22. The resilient contacts extend into the connector body in a configuration for electrical connection to a conventional or standard plug, particularly an RJ plug. A stuffer cap 24 is coupled to the housing 12, protecting the wires 20 from oxidation or corrosion.

Faceplate 50 is conventional, and has keystone envelope 48 with grooves or indentations 46.

Connector body 12 is preferably in the form of a jack. However, the connector body can be of any desired form, such as a plug, cross connect or any other connector in the telecommunications or data transmission field.

Figure 7:
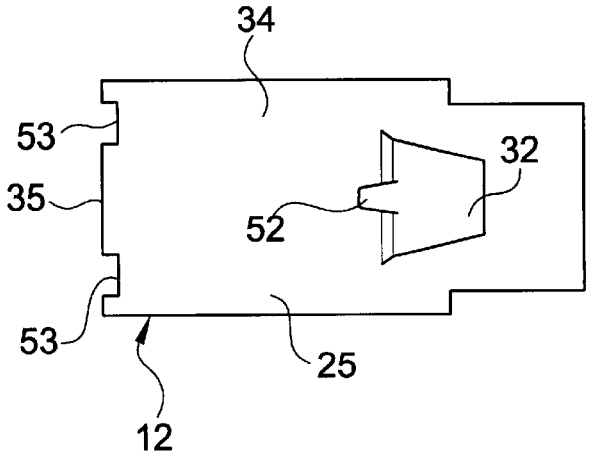
FIG. 7 is a bottom view of the electrical connector of FIG. 5.

Connector body or housing 12 is preferably a hollow plastic two piece device having a main portion 23 and a terminal cover portion 25. However, the housing may be formed from any material that would help insulate the electrical wires, terminals and circuit board from the outside environment, such as rubber or any other polymer. The main portion 23 has a forwardly opening plug receiving cavity 26 for receiving a conventional RJ plug. A shelf 30 extends rearwardly from the main portion 23 of connector body 12 and receives a portion of circuit board 16, specifically the portion of the circuit board on which the resilient contacts 22 are mounted. Shelf 30 supports circuit board 16 and facilitates the coupling between the circuit board and the connector body. Shelf 30 of main portion 23 also has two indentations 53 along the surface 34 and end face 37, as seen specifically in FIGS. 7–9. Indentations 53 are substantially rectangular recesses in the edge of face 37 and remove a portion of the corner common to face 37 and surface 34. Housing 12 also has protrusion 40 extending from side 44.

Faceplate or support latching mechanism or portion 32 extends outwardly from surface 34 of main portion 23. As seen in FIG. 1, member 31 is preferably unitary with and extends substantially perpendicularly from lower surface 34. Member 31 curves forward towards face 36 and forms latching mechanism 32. Latching mechanism is preferably integral with and extends from member 31 and is substantially parallel with surface 34. Tapered protrusion 38 extends from latching mechanism 32. Adjacent latching mechanism 32 is stuffer cap attachment portion or mechanism 52. Attachment portion 52 extends from and is preferably unitary with member 31. Portion 52 extends rearwardly and away from face 36 or toward face 37 of housing 12 and is substantially parallel with lower surface 34. Portion 52 has a protrusion or portion 54 that curves toward surface 34. Alternatively, stuffer cap attachment portion 52 can be a separate device and located away from member 31 and latching portion 32 or may couple thereto by any means desired.

Cover portion 25 is preferably placed over the terminals 18, which are coupled to circuit board 16. Cover portion 25 is fixed to main portion 23 using adhesive or any other means desired. However, portion 25 does not necessarily have to be fixed to portion 23 and may merely be positioned next to and abut portion 23.

Figure 5:
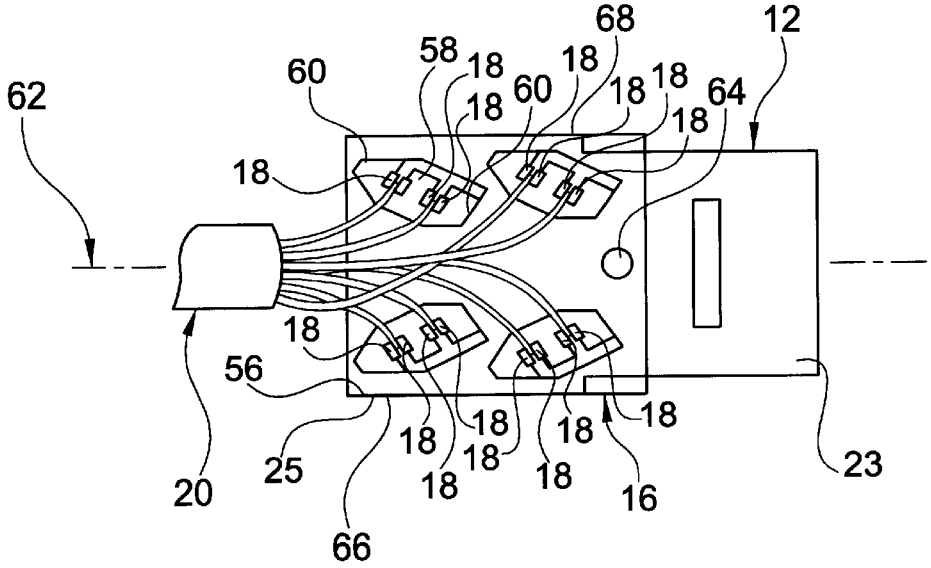
FIG. 5 is a top view of the electrical connector of FIG. 1 after insertion of the wires, but prior to coupling of the stuffer cap.

As seen in FIGS. 1 and 2, a portion 55 of the terminals extends from the cover portion 25, allowing wires 20 to be electrically connected thereto. Cover portion 25 preferably has a plastic, generally rectangular portion or base 56 with twelve protrusions 58 and 60 extending upwardly and substantially perpendicularly from the portion 56, as seen in FIGS. 1, 2 and 5. Protrusions 58 and 60 are preferably integrally formed with portion 56 and are oriented at an angle of about 30 degrees to a longitudinal axis 62 of the cover portion 25. Alternatively, the protrusions can be oriented in any direction, whether it is parallel, perpendicular or any other angle to the axis 62. Preferably, the protrusions are formed in groups of three, as seen specifically in FIG. 5, with the middle protrusions 58 extending further upwardly and away from the portion 56 than the protrusions 60, as seen in FIGS. 1 and 2. Additionally, cover portion 25, preferably has a post 64 positioned at one end and approximately in the center (i.e., along axis 62) of the cover portion with regard to sides 66 and 68. Post 64 extends to approximately the same height as protrusions 58.

Figure 3:
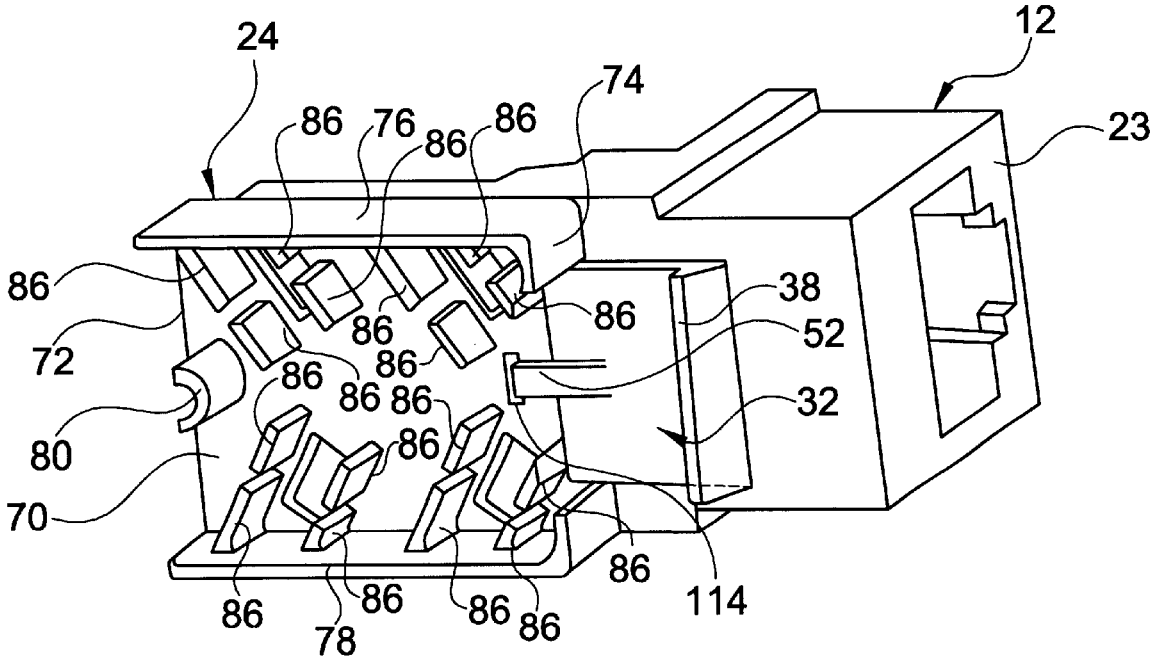
FIG. 3 is a bottom perspective view of the electrical connector of FIG. 2 with the stuffer cap attached to the stuffer cap attachment portion.
Figure 4:
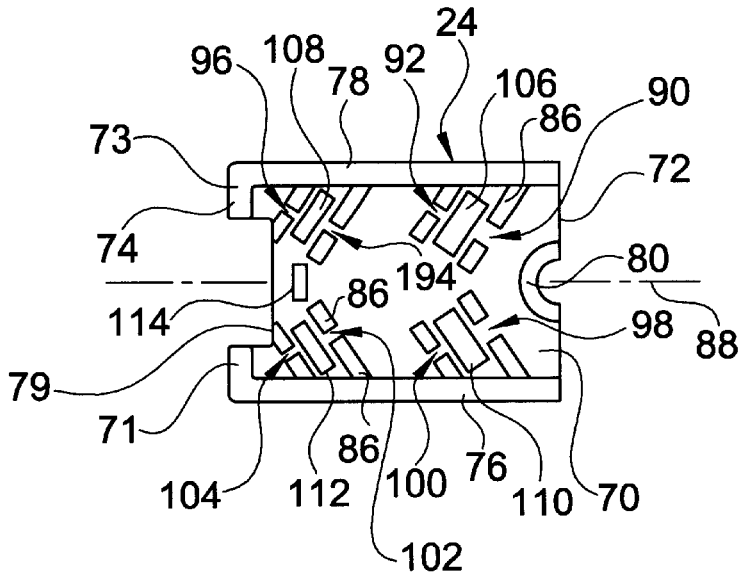
FIG. 4 is a bottom view of the stuffer cap of FIG. 1.
Figure 6:
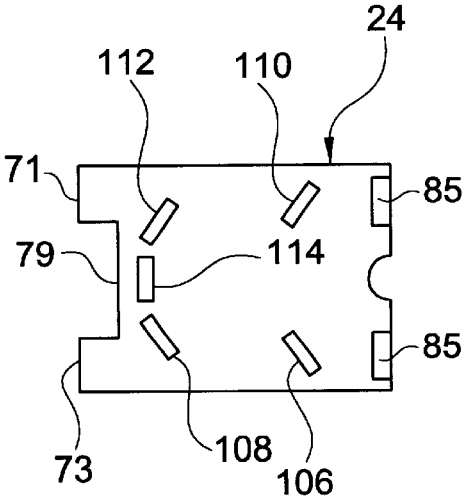
FIG. 6 is top view of the stuffer cap of FIG. 4.
Figure 8:
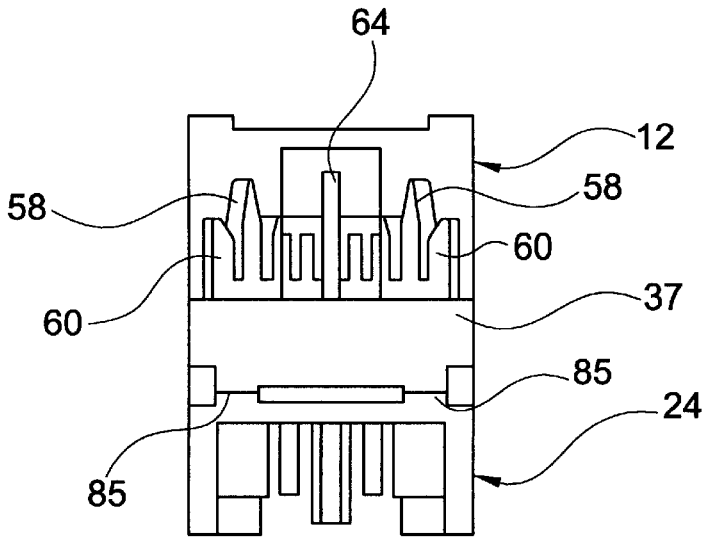
FIG. 8 is an end view of the electrical connector with the stuffer cap of FIG. 3.

As seen in FIGS. 3, 4 and 8, stuffer cap 24 is preferably U-shaped in transverse cross-section and has a substantially rectangular portion or base 70 having a first end 72 and second end 74. Two sidewalls or arms 76 and 78 extend outwardly and substantially perpendicularly from the base. However, stuffer cap 24 may be any configuration that would protect wires 20 and latching mechanism 32. First end 72 has a substantially perpendicular semi-cylindrical wall 80 extending away from base 70 to approximately the same height as walls 76 and 78. Wall 80 preferably extends along an arc of about 180 degrees; however, wall 80 may be any shape, height or size desired. Walls 76 and 78 extend substantially the entire length of sides 82 and 84 and along portions 71 and 73 of second end 74, as seen in FIG. 4. At second end 74, a portion 79 of base 70 is recessed between the facing ends of walls 76 and 78, forming a substantially rectangular opening, as seen specifically in FIGS. 4 and 6. Extending outwardly and substantially perpendicular to base 70 are two parallelepiped protrusions 85. Protrusions 85 conform in shape to fit in the indentations 53 in main portion 23 of housing 12, as seen in FIGS. 2 and 8. The coupling of protrusions 85 with the indentations 53 fixes the stuffer cap 24 in place overlying surface 34 when the stuffer cap is coupled to the attachment portion 52.

Stuffer cap 24 is preferably plastic and has a plurality of protrusions or members 86 extending upwardly or inwardly and substantially perpendicularly from base 70. Protrusions 86 are preferably unitarily formed with base 70 and are oriented at an angle of about 60 degrees to a central longitudinal axis 88 of the base, as seen in FIG. 4. However, the stuffer cap may be of any material that insulates the electrical wires and terminals from the outside environment, such as rubber or any other polymer. The protrusions can be oriented in any direction, whether it is parallel, perpendicular or any other angle to the axis 88 conforming to the orientations of insulation displacement contact terminals 18 and protrusions 58 and 60.

The protrusions preferably form pairs 90, 92, 94, 96, 98, 100, 102 and 104 and extend inwardly from either of sidewalls 76 or 78 toward the second end 74 and central axis 88, as seen in FIG. 4. Each pair of protrusions in formed along a similar line and each pair is substantially parallel to the other pairs extending from a respective sidewall, as seen in FIGS. 3 and 4. For example, pairs 90, 92, 94, and 96 are substantially parallel to each other and pairs 98, 100, 102, and 104 are substantially parallel to each other. Additionally, the protrusions are preferably formed to be oriented approximately perpendicularly to the protrusions 58 and 60 of cover portion 25 and to frictionally fit within spaces created by protrusions 58 and the adjacent protrusions 60 when the stuffer cap is mounted thereon.

Stuffer cap 24 also has five substantially rectangular apertures or holes 106, 108, 110, 112 and 114 extending entirely through the base 70. However, the holes do not necessarily have to extend through base 70 and may be grooves or depressions in base 70. Additionally, the holes may be any configuration, such as square, oval, or any other polygon desired. Holes 106, 108, 110 and 112 are positioned in the same orientation and direction as the protrusions 86, that is, extending approximately 60 degrees relative to axis 88. Each hole is positioned in-between two pairs of protrusions, as seen specifically in FIG. 4. For example, holes 106, 108, 110 and 112 are positioned between pairs 90 and 92, 94 and 96, 98 and 100, and 102 and 104, respectively. The holes preferably do not extend the entire distance of the pairs of protrusions, but may be any size or dimension desirable. Hole 114 is preferably adjacent second end 74 and extends between the innermost protrusions 86 of pairs 96 and 104.

Assembly

Initially, electrical connector 10 is preferably shipped with the stuffer cap 24 coupled to the attachment portion 52. Stuffer cap 24 is attached to the attachment portion by simply sliding the cap along surface 34 such that base 70 engages attachment portion 52 and biases it away from surface 34. The attachment portion mates with or engages the base 70 by protrusion 54 snapping into hole 114 and the attachment portion returning to is normal position relative to the surface 34. As seen in FIGS. 3 and 8, the protrusion 54 on the attaching portion 52 extends through hole 114 in the stuffer cap 24, with recess 71 fitting snugly around member 31 of the latching mechanism 32. Additionally, protrusions 85 of the stuffer cap fit into indentations 53 on housing 12. As seen in FIG. 2, the stuffer cap 24 overlies and extends from surface 34 with stuffer cap sidewalls 76 and 78 extending beyond both the latching mechanism 32 and the attaching portion 52 and extending over half the length of the housing 12. A majority of the stuffer cap 24 supports the end of the housing 12 that has the cover portion 25 and terminals 18 attached thereon. This positioning of the stuffer cap 24 supports electrical connector 10 and protects the latching mechanism 32 during termination of the wires 20 from damaging engagement with the support surface on which the free edges of sidewalls 76 and 78 engage. Additionally, the fitting of protrusions 85 into indentations 53 along with the coupling to attachment portion 52 and member 31 prevents the stuffer cap from sliding or releasing during wire termination and/or shipping. Since sidewalls 76 and 78 are substantially perpendicular from base 70, they provide a strong support protecting latching mechanism 32 and protrusions 86 from damage during termination of wires 20.

Generally, wires 20 are terminated by placing the electrical connector 10 on a level support surface and using a 110-type impact tool (116) to force the wires 20 between the terminals 18 and coupling the wires thereto, as is known in the art. The present invention allows the stuffer cap 24 to be positioned between the surface and the housing 12, separating the latching portion from the support surface. Additionally, the stuffer cap absorbs the majority of force delivered by the impact tool to the wires and transferred to the housing.

Figure 9:
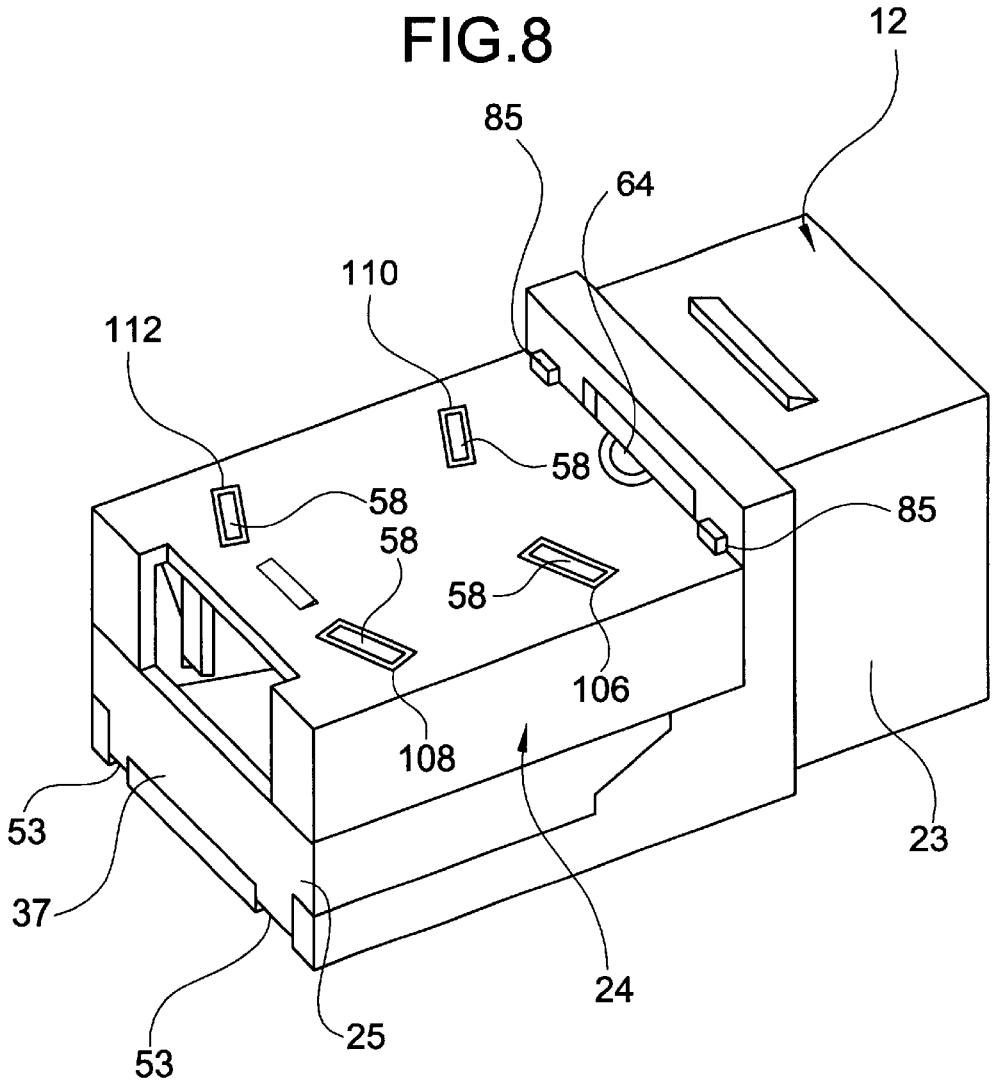
FIG. 9 is a top perspective view of the electrical connector of FIG. 1, with the stuffer cap coupled to the IDC terminals, but without the terminal wires coupled thereto.

After terminating the wires 20, the stuffer cap 24 may be removed from the attaching portion 52 by simply applying force to the stuffer cap away from member 31, such that base 70 forces attachment portion away from surface 34 and out of aperture 114 and protrusions exit from indentations 53. Stuffer cap 24 is then coupled to the terminals 18, engaging the wires 20 and securing wires to the terminals 18. The protrusions 86 on the stuffer cap are adapted to mate or fit in-between and are frictionally held by the protrusions 58 and 60 on the cover portion 25 of the housing 12, thereby protecting and holding the wires therein. Additionally, as seen in FIG. 9, a portion of the protrusions 58 fit within the apertures 106, 108, 110, and 112 and the post 64 fits within the semicylindrical space defined by wall 80, thereby aligning stuffer cap 24 over cover portion 25. Alignment of the stuffer cap during the vertical displacement that occurs during termination is critical to consistently achieving a stable termination wire/contact surface. The electrical connector 10 is then coupled to a faceplate or other support, protrusions 38 and 40 engaging keystone envelope 48 of faceplate 50 using grooves or indentations 46, in a conventional manner.

Stuffer cap 24 may also be used instead of an impact tool. The wires 20 may be partially inserted in-between the terminal, stuffer cap 24 is then positioned over the terminals 18 and forced into position. The protrusions 86 push the wires into position between the terminals, securing the wires 20 to the terminals 18.

While a specific embodiment has been chosen to illustrate the invention, it will be understood by those skilled in the art that various changes and modifications can be made therein without departing from the scope of the invention as defined in the appended claims.

What is claimed is:

1. An electrical connector, comprising:

a housing having first and second sides on opposite sides of said housing, a stuffer cap attachment on said second side and a support latching portion adjacent said attachment on said second side;

electrical wire insulation displacement contact terminals coupled to said housing and extending from said first side in a direction away from said second side; and a stuffer cap selectively and releaseably coupled on said first side over said insulation displacement contact terminals and to said attachment overlying said second side and extending from said second side beyond said support latching portion.

2. An electrical connector according to claim 1, wherein said stuffer cap is substantially U-shaped.

3. An electrical connector according to claim 1, wherein said latching portion and said attachment extend in opposite directions from a member depending from said second side.

4. An electrical connector according to claim 1, wherein said housing has a front face and a rear face; and said support latching portion extends parallel to and spaced from said second side of said housing, and forwardly toward said front face.

5. An electrical connector according to claim 4, wherein said attachment extends parallel to and spaced from said second side of said housing, outwardly and rearwardly toward said rear face.

6. An electrical connector according to claim 1, wherein said stuffer cap includes a base and a plurality of members extending therefrom, said plurality of members being coupled to portions of said housing adjacent said contact terminals when said stuffer cap is coupled on said housing over said terminals.

7. An electrical connector according to claim 6, wherein said stuffer cap has first and second arms extending outwardly and substantially perpendicularly from said base, said first and second arms extending farther from said base than said plurality of members.

8. An electrical connector according to claim 6, wherein said housing has a plurality of protrusions covering at least a portion of said insulation displacement contact terminals.

9. An electrical connector according to claim 8, wherein said stuffer cap includes a plurality of apertures, said protrusions of said housing passing at least partially through respective apertures when said stuffer cap is coupled to said housing on said first side thereof.

10. An electrical connector according to claim 8, wherein each of said plurality of members extending from said stuffer cap mates with at least one of said protrusions when said stuffer cap is mounted on said first side.

11. An electrical connector according to claim 10, wherein each of said plurality of members frictionally engages at least one of said protrusions when said stuffer cap is mounted on said first side.

12. An electrical connector, comprising:

a housing having opposite first and second sides, a front face, a rear face, a stuffer cap attachment on said second side extending from said second side rearwardly toward said rear face, a support latching portion adjacent said attachment, said latching portion extending from said second side outwardly and forwardly toward said front face, and a plurality of protrusions extending from said first side;

electrical wire insulation displacement contact terminals coupled to said housing and extending from said first side, said contact terminals covered at least partially by said protrusions; and a substantially U-shaped stuffer cap selectively coupled on said first side over said insulation displacement contact terminals and to said attachment overlying said second side and extending from said second side beyond said support latching portion.

13. A electrical connector according to claim 12, wherein said stuffer cap includes a plurality of apertures, said protrusions of said housing passing at least partially through respective apertures when said stuffer cap is coupled to said housing on said first side thereof.

14. An electrical connector according to claim 12, wherein said latching portion and said attachment extend in opposite directions from a member depending from said second side.

15. A electrical connector according to claim 12, wherein said stuffer cap includes a base and a plurality of members extending therefrom, said plurality of members being coupled to portions of said housing adjacent said contact terminals when said stuffer cap is coupled on said first side of said housing.

16. An electrical connector according to claim 15, wherein said stuffer cap has first and second arms extending outwardly and substantially perpendicularly from said base, said first and second arms extending farther from said base than said plurality of members.

17. A method for assembling a wire unit for an electrical connector, the wire unit including a housing having opposite first second sides, a stuffer cap attachment extending from the second side, a support latching portion adjacent the attachment on the second side, and insulation displacement contact terminals coupled to the housing, the terminals being at least partially covered by a plurality of protrusions on the housing, the method comprising the steps of positioning a stuffer cap overlying the second side and coupled to the stuffer cap attachment, the stuffer cap extending farther from the second side than the latching portion, placing the stuffer cap on a support surface, the stuffer cap separating the latching portion from the support surface, positioning electrical wires on the insulation displacement contact terminals, exerting a force on the electrical wires and thereby coupling the electrical wires to the insulation displacement contact terminals coupled to the housing, said stuffer cap absorbing the force transferred to the housing and protecting the latching portion, separating the stuffer cap from the stuffer cap attachment, and attaching said stuffer cap to the protrusions on the housing.

18. A method according to claim 17, further comprising the step of coupling the wire unit to a support by the latching portion.

19. A method according to claim 17, wherein the step of attaching the stuffer cap to said housing secures the electrical wires to the insulation displacement contact terminals.

20. A method according to claim 17, wherein the step of exerting a force on the electrical wires includes using an impact tool.

* * * * *